US008376765B2

(12) United States Patent
Chaize

(10) Patent No.: US 8,376,765 B2
(45) Date of Patent: Feb. 19, 2013

(54) CONNECTOR

(75) Inventor: Eric Chaize, Malton (GB)

(73) Assignee: RMSpumptools Limited (GB)

( * ) Notice: Subject to any disclaimer, the term of this patent is extended or adjusted under 35 U.S.C. 154(b) by 27 days.

(21) Appl. No.: 13/104,365

(22) Filed: May 10, 2011

(65) Prior Publication Data

US 2011/0306225 A1 Dec. 15, 2011

(30) Foreign Application Priority Data

May 11, 2010 (GB) ..... 1007841.8
Jan. 19, 2011 (GB) ..... 1100910.7

(51) Int. Cl.
*H01R 4/60* (2006.01)

(52) U.S. Cl. ..... 439/201

(58) Field of Classification Search ..... 439/181, 439/183, 184, 185, 205, 921, 201
See application file for complete search history.

(56) References Cited

U.S. PATENT DOCUMENTS

| | | | | | |
|---|---|---|---|---|---|
| 2,886,626 | A | * | 5/1959 | Burnett et al. | 174/18 |
| 3,522,576 | A | * | 8/1970 | Cairns | 439/201 |
| 3,643,207 | A | * | 2/1972 | Cairns | 439/201 |
| 3,821,690 | A | * | 6/1974 | Small | 439/140 |
| 3,972,581 | A | * | 8/1976 | Oldham | 439/201 |
| 3,980,369 | A | * | 9/1976 | Panek | 439/204 |
| 4,003,620 | A | * | 1/1977 | O'Brien et al. | 439/204 |
| 4,174,875 | A | * | 11/1979 | Wilson et al. | 439/349 |
| 4,335,928 | A | * | 6/1982 | Barrett et al. | 439/519 |
| 4,425,017 | A | * | 1/1984 | Chan | 439/276 |
| 4,494,811 | A | * | 1/1985 | Palermo, Jr. | 439/271 |
| 4,588,247 | A | * | 5/1986 | Grappe et al. | 439/271 |
| 4,696,540 | A | * | 9/1987 | Adams et al. | 385/66 |
| 4,756,595 | A | * | 7/1988 | Braun et al. | 385/75 |
| 4,880,390 | A | * | 11/1989 | Brackmann et al. | 439/204 |
| 5,188,538 | A | * | 2/1993 | Joveux-Bouillon et al. | 439/271 |
| 5,797,759 | A | * | 8/1998 | Mattis et al. | 439/201 |
| 6,213,805 | B1 | * | 4/2001 | Jedlitschka et al. | 439/271 |
| 6,315,461 | B1 | * | 11/2001 | Cairns | 385/56 |
| 6,332,787 | B1 | * | 12/2001 | Barlow et al. | 439/138 |
| 6,464,405 | B2 | * | 10/2002 | Cairns et al. | 385/56 |
| 6,832,924 | B2 | * | 12/2004 | Maletzki et al. | 439/201 |
| 8,226,303 | B2 | * | 7/2012 | Toth | 385/70 |
| 2002/0123256 | A1 | * | 9/2002 | Brickett | 439/140 |
| 2011/0304135 | A1 | * | 12/2011 | Chaize | 285/305 |
| 2011/0306225 | A1 | * | 12/2011 | Chaize | 439/201 |

FOREIGN PATENT DOCUMENTS

GB 2402560 A 8/2004

OTHER PUBLICATIONS

UK Search Report of GB1100910.7; May 6, 2011; 1 pg.

* cited by examiner

*Primary Examiner* — Tulsidas C Patel
*Assistant Examiner* — Phuongchi Nguyen
(74) *Attorney, Agent, or Firm* — Gardner Groff Greenwald & Villanueva, PC

(57) ABSTRACT

A wet-mateable connector for making a connection underwater comprises a male component 10 having a male pin 14 and a female component 20 having a female socket 24 for receiving the male pin. A fluid chamber 34 containing dielectric fluid and a water ingress treatment module 36 for removing water from the dielectric fluid are provided. The male and female components 10, 20 are arranged to be mechanically coupled together such that the female socket 24 receives the male pin 14, thereby making the connection.

8 Claims, 15 Drawing Sheets

CONNECTOR

CROSS-REFERENCE TO RELATED APPLICATIONS

This application claims priority to British Patent Application No. 1007841.8 filed on 11 May 2010, and to British Patent Application No. 1100910.7 filed on 19 Jan. 2011, which are incorporated herein by reference in their entireties.

BACKGROUND OF THE INVENTION

The invention relates to a connector for making a connection underwater, sometimes known as a "wet-mate" or "wet-mateable" connector.

So called wet-mate connectors are used in underwater applications where it is necessary to make a connection, such as an electrical or optical connection, in an environment which is hostile to contact, for example in sea water, and which therefore requires special protection for the components that complete the connection.

One example of an application in which an electrical connection must be made in a harsh underwater environment is that of a well-head in a sub-sea oil well.

After assembly of the well-head on the sea bed it is necessary to connect control cables to sensors and other electrical equipment associated with the well-head. The engagement of a control cable with a corresponding connector on the well-head may be carried out by a diver. The two connectable parts typically comprise a receptacle part and a plug part; the latter which becomes inserted within the former. Each part comprises a substantially cylindrical body part having within it the electrical contact. The electrical contact is typically provided with a protective apparatus to shield it from the surrounding sea water, in order to preserve the integrity of the connector and therefore the electrical connection when subsequently made.

The receptacle part houses a male connecting pin, and the plug part houses the complementary female contact socket. Each of the receptacle and plug is attached by a suitable termination means to respective electrical cables. In use, the receptacle part receives the plug part and as it does so the male pin contact penetrates and makes electrical connection with the female contact socket. Various designs of such connector exist in which there may be a single male pin engaging with a single contact module, or else a plurality of male pins and respective contact modules.

In all cases measures must be taken to prevent the electrical contacts from being exposed to sea water and other harmful matter, such as oil and drilling fluid for example. Maintaining a good seal around the electrical contacts may be necessary for long periods. In order to provide protection for the electrical contacts a number of mechanisms are employed. These include one or more wiper seals arranged to wipe contaminants from the contacts as first a mechanical, and then an electrical, connection is made between the connecting parts. Another common measure is the use of a so called shuttle pin which occupies in an unconnected configuration a position within the female contact module which will subsequently be occupied by the male contact pin when electrical connection is made. In one typical arrangement the plug is generally cylindrical with an outer housing surrounding a generally cylindrical contact module in which is mounted an axially slidable resiliently biased shuttle pin. The receptacle part is also generally cylindrical and houses a cylindrical male connector pin. When the plug is inserted into the receptacle the male contact pin of the latter axially engages the shuttle pin, and as mechanical engagement is continued the male pin axially displaces the shuttle pin though the contact module until electrical connection is made between the male pin and the female contact module. Typically a wiper seal on the plug wipes the male pin as it penetrates the plug.

Since well-heads are frequently located at great depth, the connector parts need to be pressure balanced. This is usually achieved by filling chambers in the connector parts with a pressurised dielectric oil, and providing one or more expandable bladders or diaphragms to accommodate movement of the oil as mechanical and electrical engagement is made and unmade.

As well-head connections become more complex with increasing requirements for monitoring and control equipment, the space available for connectors of the kind described above becomes reduced, and thus the need for more compact connectors increases.

SUMMARY OF THE INVENTION

Embodiments of the invention aim to provide a wet-mateable electrical connector for underwater applications which is compact and reliable and which provides improved protection for the electrical contacts therein.

The invention is defined in the attached independent claim to which reference should now be made. Further optional features may be found in the sub claims appended thereto.

In a broad aspect the invention relates to a wet-mateable connector for making a connection underwater comprising: a male component having a male pin and a female component having a female socket for receiving the male pin; wherein the male and female components are arranged to be mechanically coupled together such that the female socket receives the male pin, thereby making the connection. The connector may comprise a fluid chamber containing dielectric fluid disposed in the male or female component and may further comprise a water ingress treatment module for removing water from the dielectric fluid. The male component may comprise a male wiper seal assembly which moves between a decoupled and a coupled position during coupling of the male component and female component so as to wipe at least a portion of the male pin. The connector may further comprise a latch arranged to latch the male wiper seal assembly to the female component during coupling such that when the male and female components are decoupled, the male wiper seal assembly is returned to the decoupled position.

According to an aspect of the invention there is provided a wet-mateable connector for making a connection underwater comprising: a male component having a male pin and a female component having a female contact socket for receiving the male pin; and a fluid chamber containing dielectric fluid and a water ingress treatment module for removing water from the dielectric fluid; wherein the male and female components are arranged to be mechanically coupled together such that the female socket receives the male pin, thereby making the connection. The fluid chamber may be disposed or located in the male or female component. The water ingress treatment module may be disposed within the fluid chamber.

The connector may be arranged such that coupling of the male and female components causes the dielectric fluid to flow through the water ingress treatment module. The flow of dielectric fluid may be caused by a change of volume within the fluid chamber.

One of the components may comprise a shuttle pin at least partially disposed within the fluid chamber that moves within the fluid chamber as the male and female components are coupled, thereby causing the dielectric fluid to flow through the water ingress treatment module. The female component may comprise the shuttle pin which may be part of a contact module which may also comprise the contact socket. Upon coupling, the male pin may act on the shuttle pin so as to move it within the fluid chamber. At least part of the contact module may be disposed in the fluid chamber. A portion of the shuttle pin may extend outside of the fluid chamber. A wiper seal may surround the shuttle pin so as to seal the fluid chamber. There may be a second axially spaced wiper seal which defines a further fluid chamber arranged to contain dielectric fluid.

The shuttle pin may be axially moveable. The shuttle pin may be moveable within an outer sleeve, which may form part of a contact module, the interior of which is in fluid communication with the fluid chamber.

The fluid chamber may be sealed. The water ingress treatment module may comprise a molecular sieve.

The male component may comprise a male wiper seal assembly which moves between a decoupled and a coupled position during coupling of the male component and female component so as to wipe at least a portion of the male pin. A latch may be provided which is arranged to latch the male wiper seal assembly to the female component during coupling such that when the male and female components are decoupled, the male wiper seal assembly is returned to the decoupled position. The latch may be arranged to latch the male wiper seal assembly to a nose, or front, portion of the female component.

The latch may comprise corresponding latch parts provided on the male wiper seal assembly and the female component that are arranged to engage with one another so as to latch the male wiper seal assembly to the female component. At least one of the corresponding latch parts may be resiliently deformable. One of the latch parts may be a cantilevered plate. The latch may comprise a male latch projection and a female latch recess that are arranged to be engaged with one another.

The male wiper seal assembly may be axially moveable.

The female component may comprise a female wiper seal disposed such that when the male wiper seal assembly is latched to the female component, the male and female wiper seals abut.

The male component may further comprise a retainer that when engaged retains the male wiper seal assembly in the decoupled position, thereby restricting the movement of the male wiper seal assembly. The retainer may be arranged to be automatically disengaged during coupling of the male and female components, such that the male wiper seal assembly can move to the coupled position. The retainer may be arranged to be disengaged by applying a coupling force to the male wiper seal assembly from the female component in a direction towards the coupled position. The coupling force required to disengage the retainer may be greater than the force required to engage the latch such that during coupling of the male and female components the latch engages before the retainer disengages. The retainer may prevent the male wiper seal assembly from being withdrawn from the male component.

The retainer may comprise a retaining member and a corresponding retaining recess, at least one of which is resiliently deformable. The retaining member may be substantially annular and may be disposed in a substantially annular recess provided in the male wiper seal assembly or in the male component, and wherein the retaining recess may be formed in the other of the male wiper seal assembly and the male component.

The connector may be an electrical connector and/or an optical connector.

According to another aspect of the invention there is provided a wet-mateable connector for making an electrical connection underwater, comprising a male component having a male electrical contact pin and a female component having a female electrical contact socket for receiving the male electrical contact pin, characterised in that the connector comprises a sealed portion containing dielectric fluid and a water ingress treatment module for removing water from the dielectric fluid. The water ingress treatment module may comprise a molecular sieve.

According to another aspect of the invention there is provided a wet-mateable connector for making an electrical connection underwater, comprising a male component having a male electrical contact pin and a female component having a female electrical contact socket for receiving the male electrical contact pin, characterised in that the male component has a wiper assembly arranged to wipe the male contact pin during engagement between the male component and female component, and wherein the wiper assembly comprises a latch means arranged in use to latch onto a corresponding part of the female component during engagement of the male and female components.

According to another aspect of the invention there is provided a wet-mateable connector for making an electrical connection underwater, comprising a male component having a male electrical contact pin and a female component having a female electrical contact socket for receiving the male electrical contact pin, characterised in that the female component has primary and secondary wiper seals arranged to wipe the male component during engagement and disengagement.

BRIEF DESCRIPTION OF THE DRAWINGS

An embodiment of the invention will now be described by way of example only with reference to the accompanying diagrammatic drawings in which.

DESCRIPTION OF AN EMBODIMENT OF THE INVENTION

Figure 1:
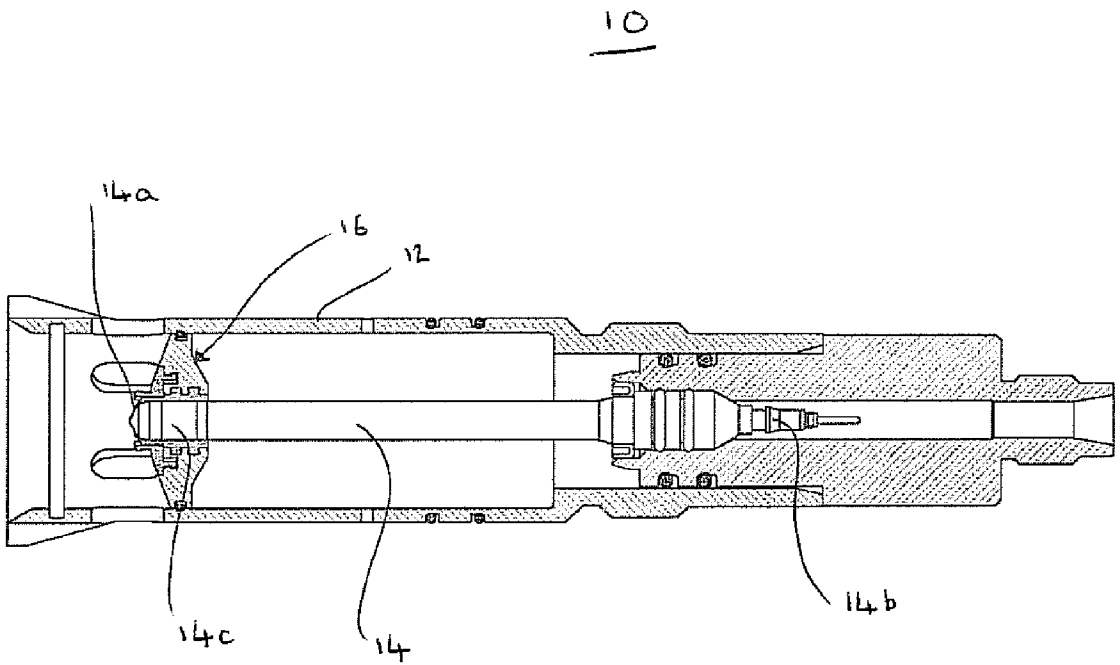
FIG. 1 is a part sectional view of a male component of a connector assembly according to an embodiment of the invention.

FIG. 1 shows generally at 10 a male component of a connector assembly according to an embodiment of the invention. The male component 10 comprises a substantially cylindrical hollow shroud housing 12, inside which is located a male contact pin 14 which has a first end 14*a*, an annular contact band 14*c* for making a disengageable electrical contact with a female component (not shown in FIG. 1, and to be described later) and a second end 14*b* comprising an electrical terminal for permanent connection to an electrical cable (not shown).

Mounted on the male pin 14 and axially slidable thereon is a self-latching wiper seal assembly shown generally at 16, and to be described in more detail below. In FIG. 1 the wiper seal assembly 16 is in the decoupled position.

Figure 2:
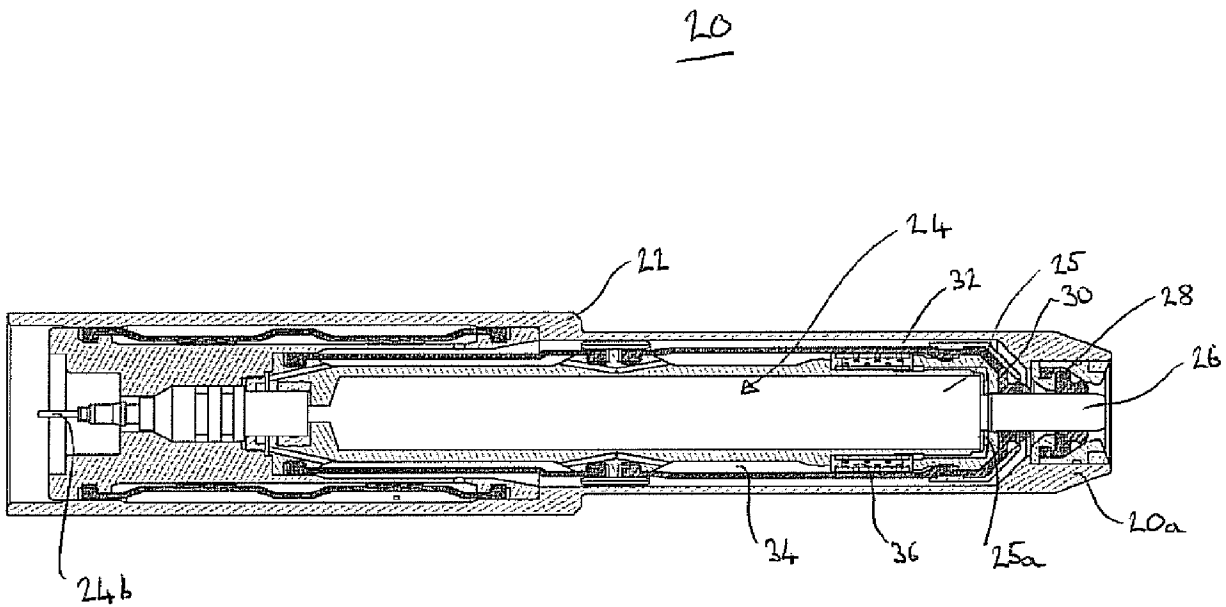
FIG. 2 is a part sectional view of a female component of a connector assembly for cooperation with the male component of FIG. 1, according to an embodiment of the invention.

FIG. 2 shows generally at 20 a female component of a connector assembly according to an embodiment of the invention. The component 20 comprises a substantially cylindrical hollow housing 22 inside which is located a female contact module 24 comprising an outer sleeve 25.

Located telescopically within the outer sleeve 25 of the contact module 24 is an axially slidable shuttle pin 26, which in the disengaged configuration depicted in FIG. 2, emerges from an open end 25*a* of the outer sleeve 25 of the contact module 24. At an opposed end 24*b* of the contact module 24 is a cable termination, to which an electrical cable (not shown) is permanently connected in use. A primary wiper seal 28 and an axially spaced secondary wiper seal 30 are located around the shuttle pin 26. The primary and secondary wiper seals 28 are substantially annular and are axially fixed with respect to the housing 22.

The first wiper seal 28 makes and maintains an intimate annular contact with the shuttle pin 26. The first wiper seal 28 also retains a first dielectric fluid under pressure in a first dielectric fluid chamber 32.

The second seal 30 also makes and maintains an intimate annular contact with the shuttle pin 26. The second wiper seal 30 retains a second dielectric fluid within a second dielectric chamber 34. Within the second dielectric fluid chamber 34 a water ingress treatment module 36, in the form of a molecular sieve, has the function of removing any droplets of water or other contaminant that may have been inadvertently introduced into the second dielectric fluid.

Within the contact module 24 is a substantially annular electric contact (not shown) arranged in use to make an electric contact with the contact band 14*c* of the male contact pin 14 of FIG. 1, when the male and female components 10 and 20 are in complete electrical and mechanical union. As will be described below, the electrical contact is made when the shuttle pin 26 becomes axially displaced by the male contact pin 14 of FIG. 1.

FIGS. 3*a*-3*h* show schematically in stages the mechanical and eventual electrical engagement between the male component 10 and female component 20, described above in relation to FIGS. 1 and 2. Reference numerals used in these figures remain the same throughout.

The component 10, otherwise known as the "receptacle", despite physically receiving its counterpart 20, is conventionally described as the male component due to the presence within it of the male contact pin 14 which is arranged in use to penetrate the component 20. Likewise, although the component 20, often referred to as a "plug", is arranged to enter the component 10, it is conventionally referred to as the female component because the contact module 24 within it is arranged in use to be penetrated by the male contact pin 14.

Figure 3A:
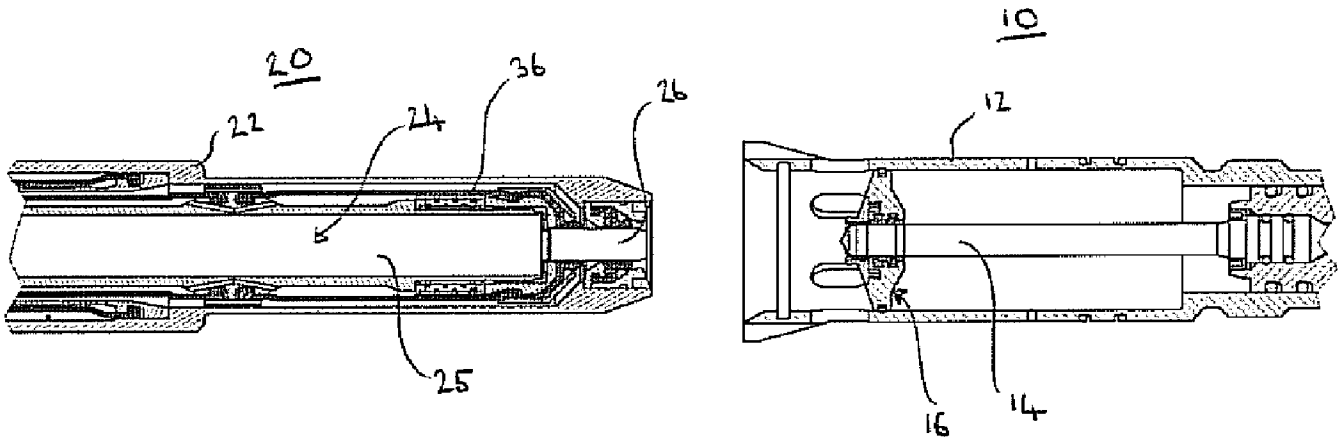
FIGS. 3*a*-3*h* show schematically the male component of FIG. 1 and female component of FIG. 2 at various stages during mechanical and electrical engagement.

FIG. 3*a* shows the male 10 and female 20 components spaced apart, but axially aligned and ready for engagement.

Figure 3B:
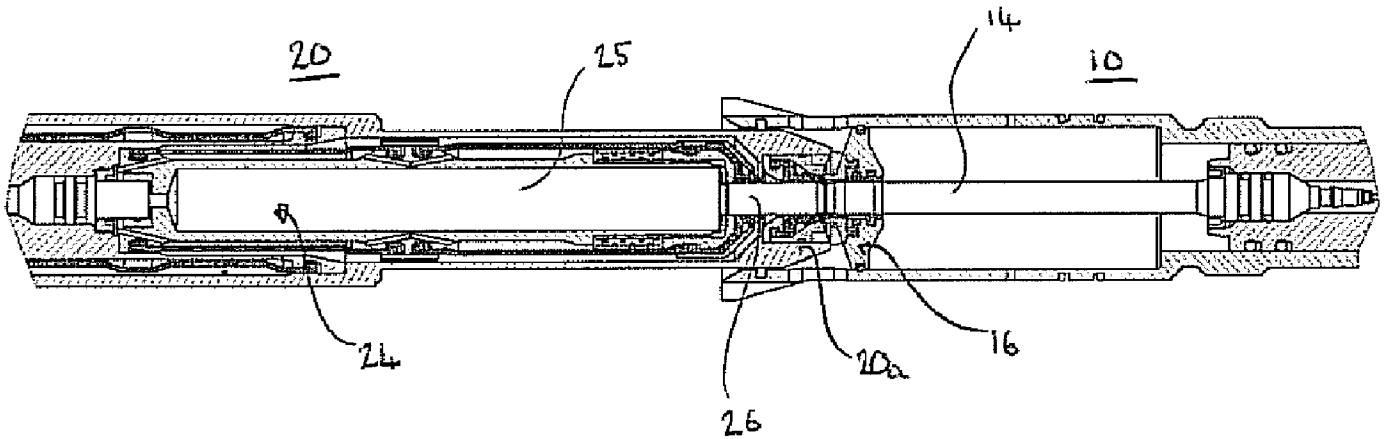

In FIG. 3*b* a plug nose portion 20*a* of the female component 20 comes into contact with the front of the wiper seal assembly 16 of the male component 10.

Figure 3C:
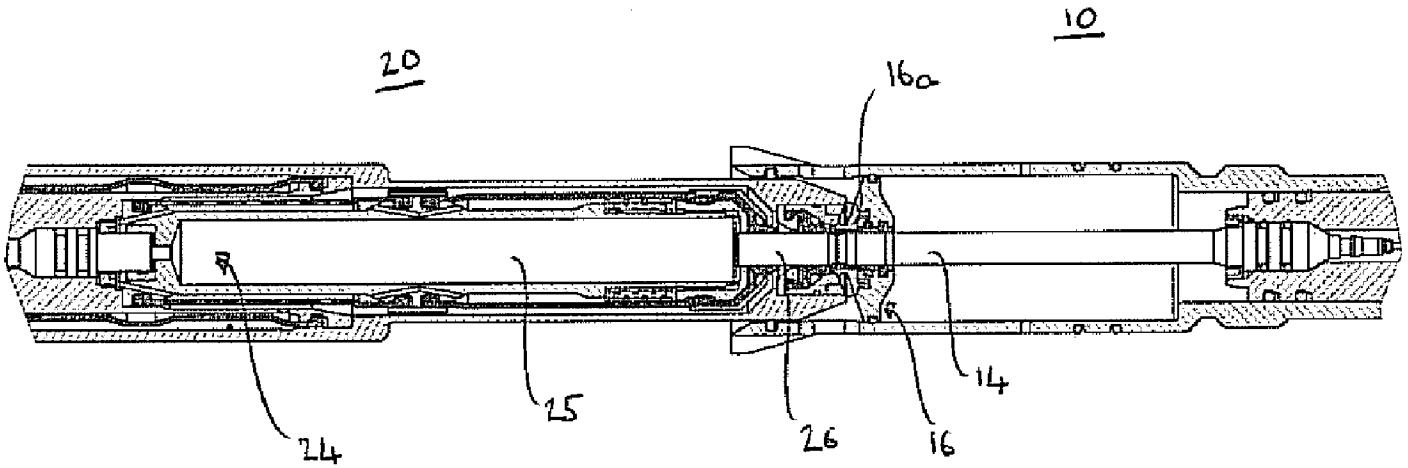

FIG. 3*c* shows the male contact 14 of the male component 10 coming into contact with the axially slidable shuttle pin 26 of the female component 20. In addition, a latch portion 16*a* of the wiper seal assembly 16, described in more detail below, begins to latch with a corresponding profile of the front portion 20*a* of the female component 20.

Figure 3D:
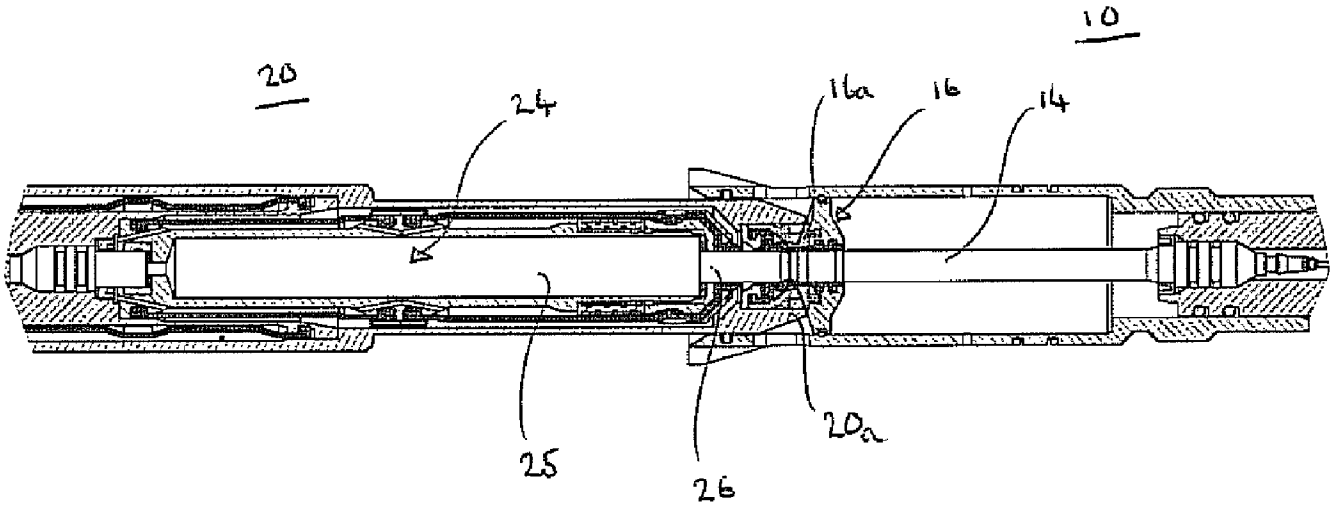

In FIG. 3*d*, the latch portion 16*a* is fully engaged with the front end 20*a* of the female component 20. The male contact pin 14 has begun to push back the shuttle pin 26 into the contact module 24 of the female component 20.

Figure 3E:
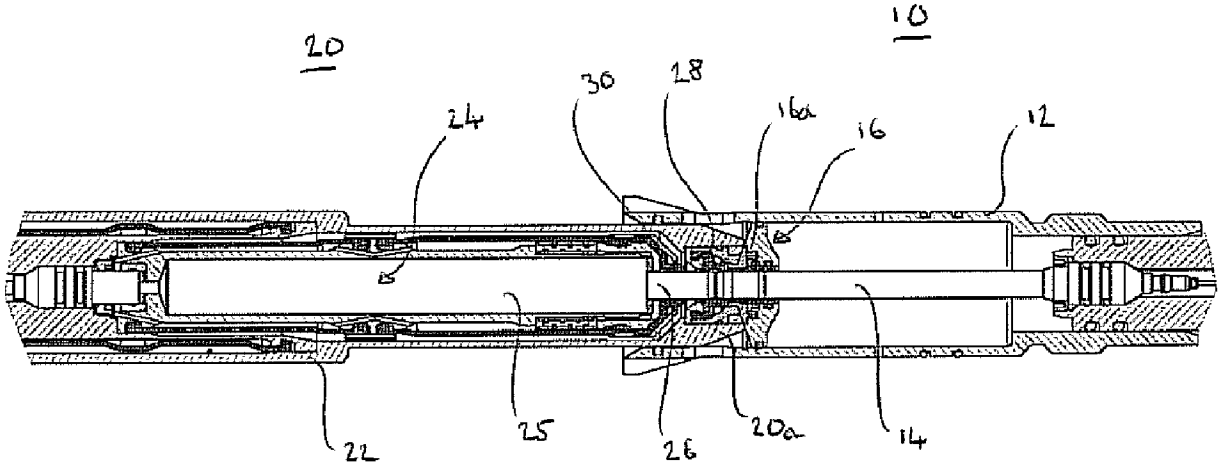
Figure 3F:
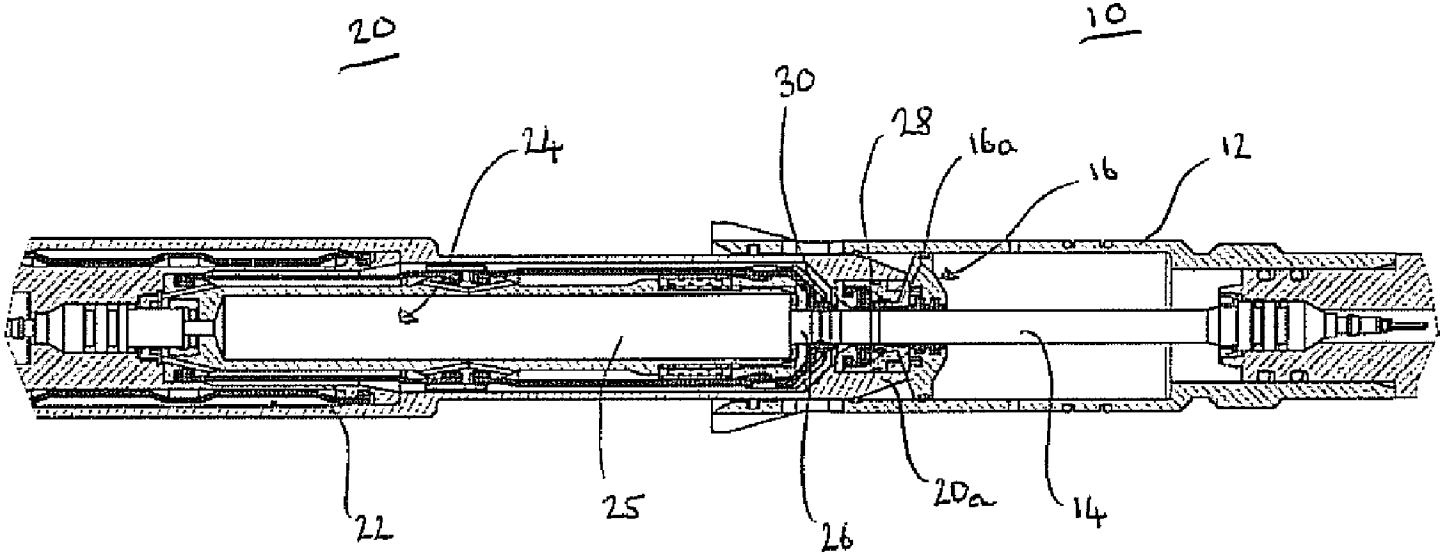

FIG. 3*e* shows the male component pin 14 has now pushed through the primary wiper seal 28 of the female component, driving the shuttle pin 26 further into the contact module 24. A continuous seal is maintained by the primary wiper seal 28 between the shuttle pin 26 and the male contact pin 14. In the male component 10 the seal assembly 16 has begun to be pushed back further into the housing 12 by the front portion 20*a* of the female plug component, as it does so sliding axially on the male contact pin 14. In FIG. 3*f* the male contact pin 14 is shown passing through the second wiper seal 30.

Figure 3G:
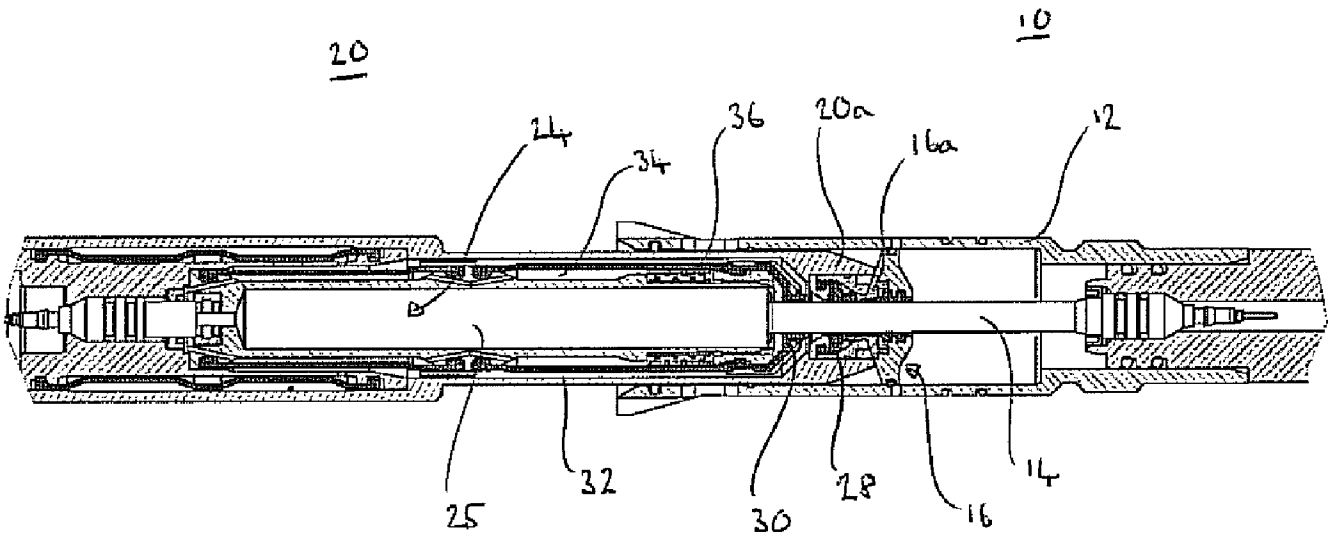
Figure 3H:
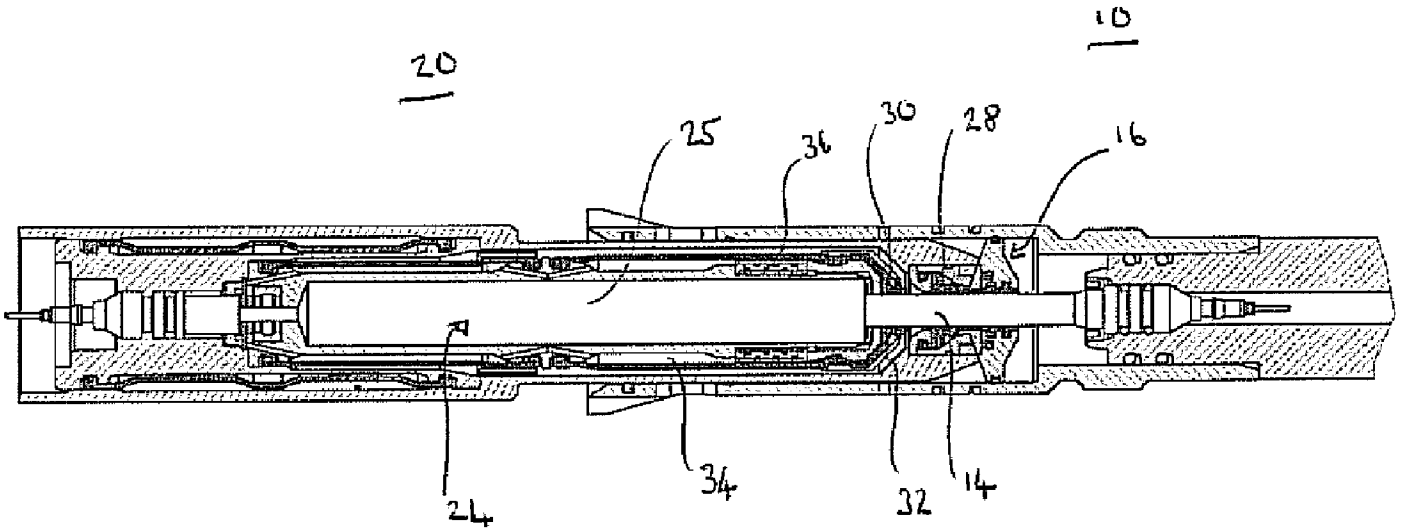

FIGS. 3*g* and 3*h* show the arrangements of the connector components 10 and 20 in the final stages of electrical and mechanical engagement. Inside the contact module 24 the male contact pin 14 makes an electrical connection with its counterpart female contact (not shown). The rearward movement of the shuttle pin 26 causes dielectric oil in the second dielectric fluid chamber 34 to flow through the water ingress treatment module 36, which removes any traces of water in the dielectric fluid so as to maintain the electrical performance of the dielectric fluid. The male wiper seal assembly 16 has moved axially over the male contact pin 14 rearwards into the housing 12 and is in the coupled position.

FIGS. 4*a*-4*e* show schematically a more detailed part sectional view of the engagement of the male 10, and female 20, components.

Figure 4A:
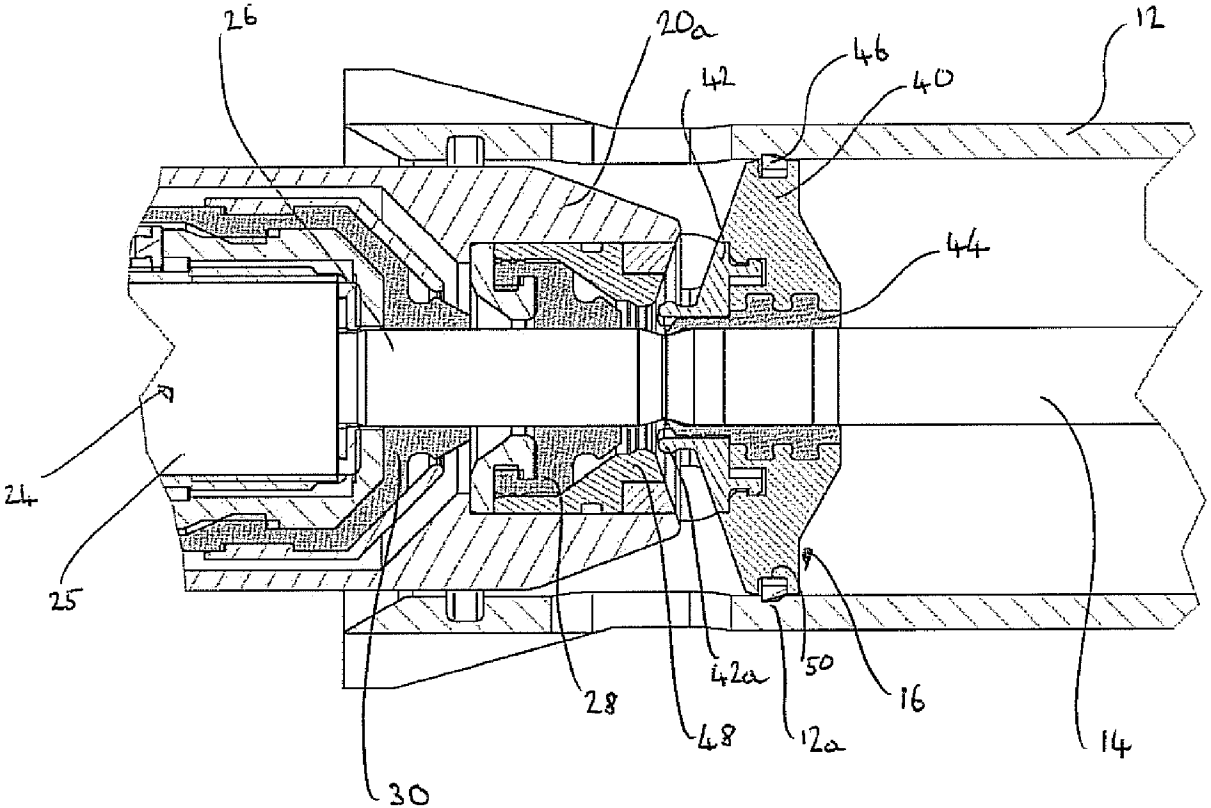
FIGS. 4*a*-4*e* show schematically in more detail some of the stages depicted in FIGS. 3*a*-3*h*.

FIG. 4*a* shows the male 10 and female 20 components at initial contact. The male wiper seal assembly 16 is substantially annular and surrounds the male contact pin 14. In FIG. 4*a* the wiper seal assembly 16 is shown in the normal resting decoupled position. The male wiper seal assembly 16 comprises a cap body 40, a resilient cantilever latch plate 42, a solid rubber sleeve 44 and a resilient slotted retaining (latching) ring 46. In the decoupled position the retaining ring 46 is engaged, or located, in an annular groove 12*a* formed on an inner surface of the housing 12 which retains the wiper seal assembly 16 in the decoupled position when the male and female components 10, 20 are decoupled. The nose part 20*a* of the female plug component 20 comprises an annular sleeve 48 having a female profile which is an annular recess arranged to receive and latch with a corresponding male profile 42*a* which is an annular projection at the tip of the cantilever plate 42.

Figure 4B:
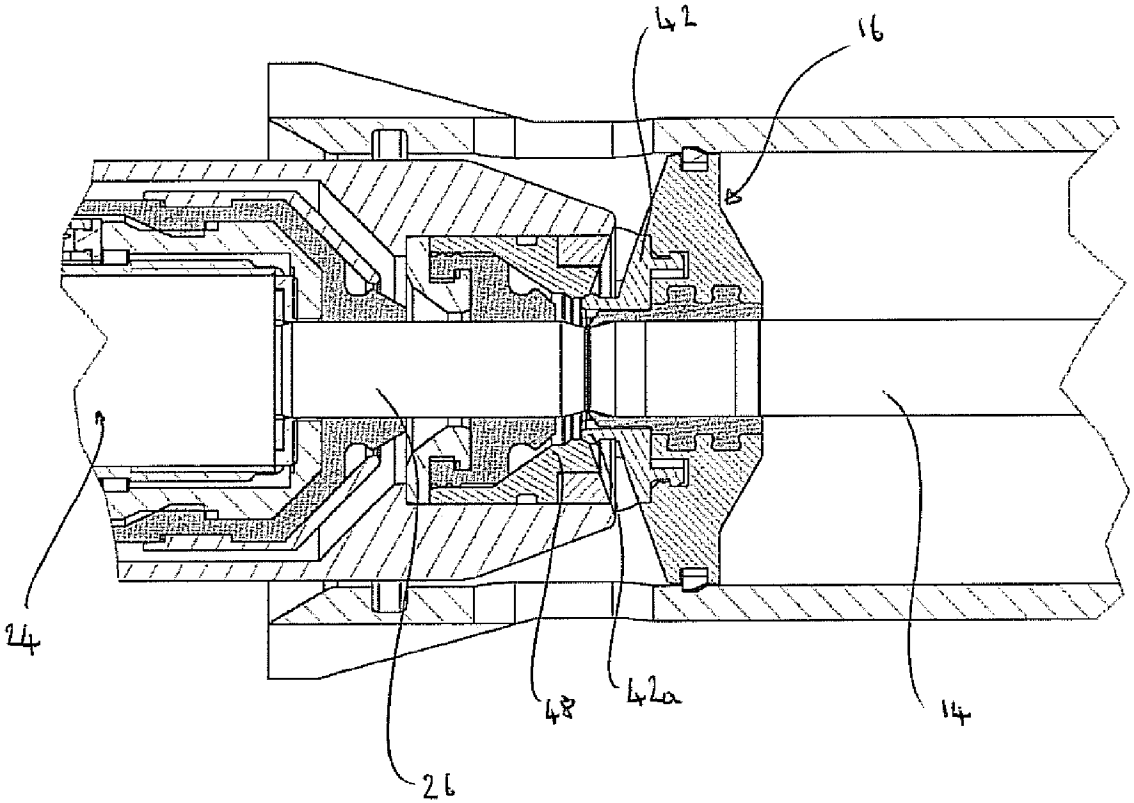

In FIG. 4*b* the distal end 14*a* of the male contact pin 14 abuts the distal end of the shuttle pin 26 and the complementary latching profiles of parts 48 and 42*a* start to fully engage with one another.

Figure 4C:
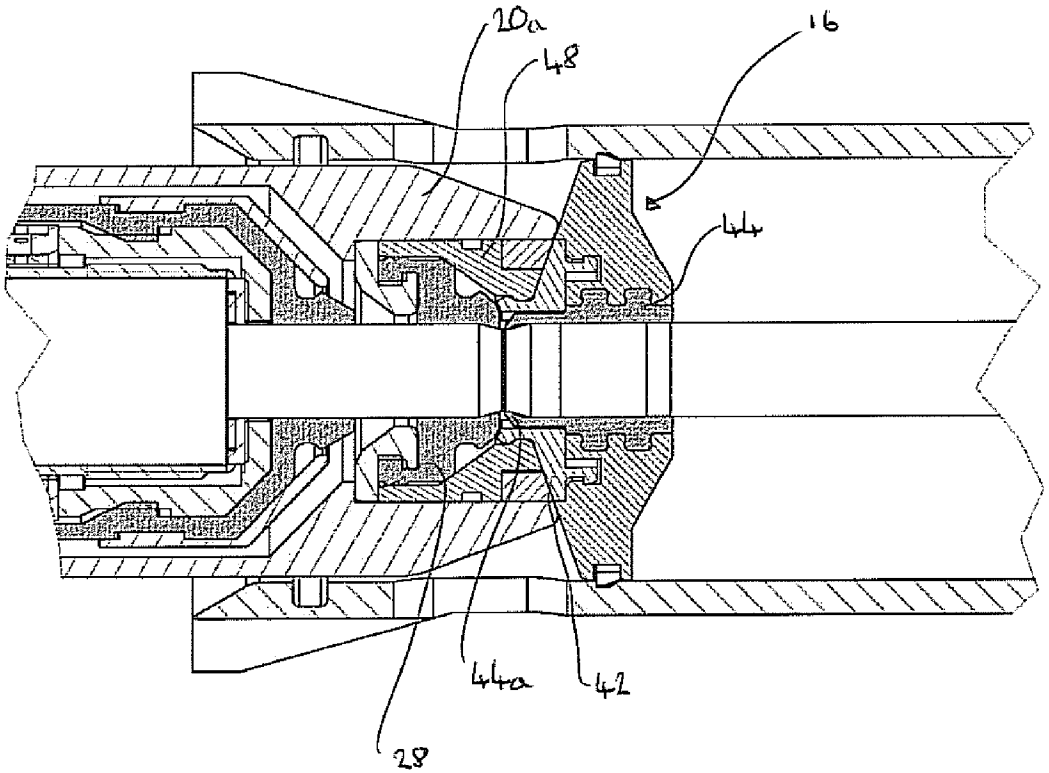

In FIG. 4*c* the latching is complete and the male profile of the resilient cantilever latch plate 42 is engaged with the female profile of the annular sleeve 48 of the female component 20. The male wiper seal assembly 16 of the male component 10 is secured, or latched, to the nose part 20*a* of the female component 20 by the corresponding latching profiles. A lip 44*a* of the protective rubber sleeve 44 abuts the first wiper seal 28 of the female component to form a water-resistant barrier prior to the passing of the male contact pin 14 though the first wiper seal 28.

Figure 4D:
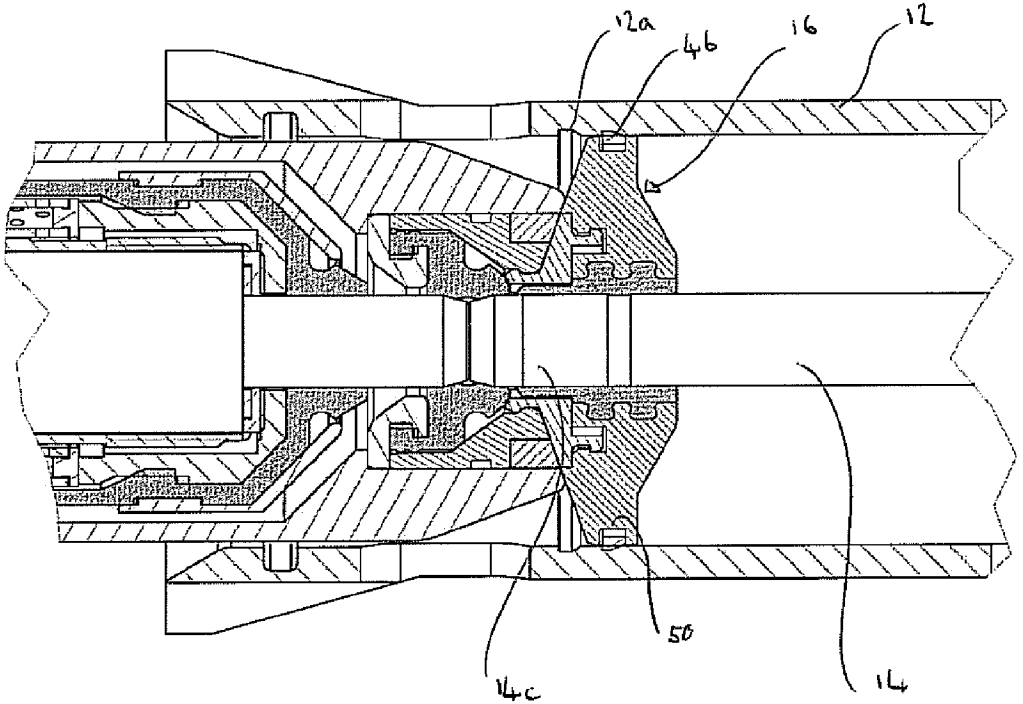

FIG. 4*d* shows the wiper seal assembly 16 of the male component 10 passing further into the housing 12 of the male component as its slides axially over the male contact pin 14. The slotted retaining ring 46 has become compressed and is disengaged from the annular groove 12*a*. The retaining ring 46 axially moves with the wiper seal assembly 16 since it is constrained within an annular groove 50 around the wiper seal assembly 16 inside the bore of the housing 12.

Importantly, in this particular embodiment, the coupling force required to disengage the retaining ring 46 from the annular groove 12*a* is greater than the force required to engage the latch between the annular sleeve 48 of the female component 20 and the male wiper seal assembly 16. This ensures that upon coupling of the male and female components, the male wiper seal assembly 16 is latched to the female component 20 before the retaining ring 46 is disengaged.

Figure 4E:
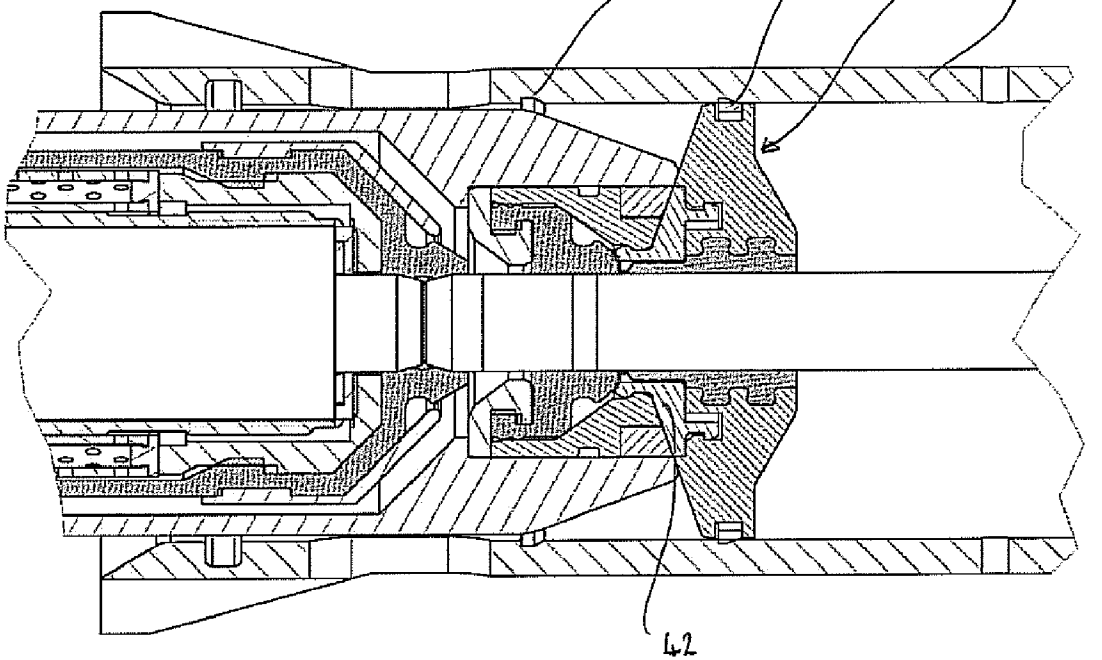

FIG. 4*e* shows that when disengaging the male 10 and female 20 components, the male wiper seal assembly 16 of the male contact pin 14 is drawn out and axially forwards from the coupled position by its latched engagement with the plug 20*a* of the female component 20, such that it returns towards its non-engaged, or decoupled, position. The latching engagement between the profile 48 (on the female component 20) and 24*a* (on the wiper assembly 16) becomes finally disengaged when the resilient slotted retaining ring 46 reaches the annular groove 12*a* in the bore of the housing 12, which prevents further withdrawal of the latching wiper assembly 16, resulting in the temporary resilient deformation of the cantilever plate 42.

A key advantage provided by the self-latching facility of the wiper assembly 16 is that the wiper assembly returns to its starting position when the male and female components become disengaged, and it does so without the need for any biasing means such as springs, which take up much-needed space and may be prone to failure.

Although it is described that the male wiper seal assembly 16 comprises a male latching portion that is arranged to latch with a female latching portion provided on the female component, it will be appreciated by one skilled in the art that the male latching portion may be provided on the female component and the female latching portion may be provided on the male wiper seal assembly. Furthermore, it is not essential that the corresponding latching parts provided on the male wiper seal assembly and the female component comprise a resiliently deformable portion. In some embodiments the latching parts may be magnetic, for example.

As will be readily appreciated by one skilled in the art, although it has been described that the connector is an electrical connector, the connector could be an optical connector or a hydraulic connector or any combination thereof, for example.

The invention claimed is:

1. A wet-mateable connector for making a connection underwater comprising:

a male component having a male pin and a female component having a female socket for receiving the male pin, the male and female components being arranged to be mechanically coupled together such that the female socket receives the male pin, thereby making the connection;

a fluid chamber containing dielectric fluid;

a water ingress treatment module disposed within the fluid chamber and comprising a molecular sieve for removing water from the dielectric fluid; and a shuttle pin provided in one of the male and female components and at least partially disposed within the fluid chamber;

wherein as the male and female components are coupled, the shuttle pin moves within the fluid chamber, thereby displacing the dielectric fluid through the molecular sieve.

2. A wet-mateable connector according to claim 1, wherein a portion of the shuttle pin extends outside of the fluid chamber.

3. A wet-mateable connector according to claim 1, wherein the shuttle pin is axially moveable.

4. A wet-mateable connector according to claim 1, wherein the shuttle pin is moveable within an outer sleeve, the interior of which is in fluid communication with the fluid chamber.

5. A wet-mateable connector according to claim 1, wherein the fluid chamber is disposed in the female component.

6. A wet-mateable connector according to claim 1, wherein the fluid chamber is sealed.

7. A wet-mateable connector according to claim 1, wherein the connector is an electrical connector and/or an optical connector.

8. A wet-mateable connector for making a connection underwater comprising:

a male component having a male pin;

a female component having a female socket for receiving the male pin, a fluid chamber containing dielectric fluid, a shuttle pin at least partially disposed within the fluid chamber, and a water ingress treatment module comprising a molecular sieve disposed within the fluid chamber;

wherein the male and female components are arranged to be mechanically coupled together such that the female socket receives the male pin, thereby making the connection; and wherein as the male and female components are coupled, the shuttle pin moves within the fluid chamber, thereby causing the dielectric fluid to flow through the water ingress treatment module to remove water from the dielectric fluid.

* * * * *